United States Patent [19]

Asakawa et al.

[11] 4,077,805

[45] Mar. 7, 1978

[54] LIGHT-SENSITIVE COMPOSITION CONTAINING ANTIOXIDANT

[76] Inventors: Shirow Asakawa; Yukihiro Saito; Katsue Hasegawa, all c/o Matsushita Research Institute Inc., No. 4896, Aza Ohtani, Ikuta, Kawasaki, Japan

[21] Appl. No.: 690,105

[22] Filed: May 26, 1976

Related U.S. Application Data

[63] Continuation-in-part of Ser. No. 518,207, Oct. 25, 1974, abandoned.

[51] Int. Cl.[2] ..... G03C 1/58; G03C 1/00

[52] U.S. Cl. ..... 96/115 P; 96/88; 96/90 R

[58] Field of Search ..... 96/90 R, 90 PC, 115 P, 96/88

[56] References Cited

U.S. PATENT DOCUMENTS

| | | | |
|---|---|---|---|
| 3,476,562 | 11/1969 | Yamada et al. | 96/90 R |
| 3,510,309 | 5/1970 | Lewis | 96/90 R |
| 3,544,321 | 12/1970 | Yamada et al. | 96/90 R |
| 3,697,276 | 10/1972 | Lewis et al. | 96/90 R |
| 3,736,139 | 5/1973 | Yamashita et al. | 96/90 R |

*Primary Examiner*—Won H. Louie, Jr.
*Attorney, Agent, or Firm*—Balogh, Osann, Kramer, Dvorak, Genova & Traub

[57] ABSTRACT

A composition in the form of a dispersion in a hydrophilic continuous phase of a combination of N-vinylcarbazole, a halogenated hydrocarbon, 4-(p-dimethylaminostyryl)-quinoline as a sensitizer and a phenol derivative, as a shelf life extending additive, having the formula where $R_1$ and $R_2$ are individually $C_1$ to $C_4$ alkyl, and $R_3$ is hydrogen, hydroxyl groups, $C_1$ to $C_4$ alkyl or $C_1$ to $C_4$ alkoxyl. The amount of the additive is in the range from 0.001 to 0.1 Wt% of N-vinylcarbazole.

9 Claims, 8 Drawing Figures

LIGHT-SENSITIVE COMPOSITION CONTAINING ANTIOXIDANT

This application is a continuation-in-part of Ser. No. 518,207 filed Oct. 25, 1974, now abandoned.

The present invention relates generally to light-sensitive compositions essentially consisting of N-vinylcarbazole and a halogenated hydrocarbon, and more particularly to a composition containing in addition to the above essential components 4-(p-dimethylaminostyryl)-quinoline as a sensitizer and a phenol derivative as a stabilizer.

It is well known in the photographic art that a combination of a halogenated hydrocarbon which liberates free radicals or ions upon exposure to actinic light and an N-vinyl compound which forms color with the halogenated hydrocarbon under the influence of actinic light provides a series of excellent light-sensitive compositions. A typical example of practical compositions based on such a combination is a dispersed phase in the form of discrete particles of the combination in a solid-film-forming hydrophilic binder, e.g. gelatin, as shown in U.S. Pat. Nos. 3,476,562 and 3,607,266.

This light-sensitive composition is eminent both in its extremely high photosensitivity and in the complete dryness of photographic processes for it. Some problems, however, must be solved to make this composition really practical. Among the problems, a comparatively short shelf life of the composition is of significance. Photographic materials, e.g. films and papers, coated with this composition exhibit relatively rapid deterioration in their characteristics, especially in the sensitivity, during storage. Various stabilizers have been proposed until now to overcome this shortcoming.

For example, U.S. Pat. No. 3,042,516 discloses that the addition of a certain sulfur compound, either organic or inorganic, into a light-sensitive composition essentially consisting of a diphenylamine and carbon tetrabromide improves the stability of the composition. The above-referred U.S. Pat. No. 3,476,562 suggests that the stabilization and/or shelf life for the disclosed composition may be improved by the inclusion in the composition of a certain amide, phenol or alkaline reacting amine. According to this patent, the amines and phenols which may be used are various $C_2$–$C_4$ alkylene diamines, di- to hexa-($C_1$–$C_4$) alkylene polyamines, and mono- or dihydroxy aryl phenols having as many as two ($C_1$–$C_4$) alkyl groups attached to the benzene nucleus, and the amount of the additive may be within the range of about 0.01% to about 5% of the essential combination, i.e., a halogenated hydrocarbon and an N-vinyl compound. U.S. Pat. No. 3,697,276 discloses a photosensitive composition, which is a dispersion of the combination of an N-vinyl monomer and a halogenated hydrocarbon in polyvinylcarbazole, and teaches the usefulness of some cresols and phenols as a shelf stabilizing additive. The amount of the stabilizing additive is recommended in this patent to be in range from about 5 to about 100% of the N-vinyl monomer.

Apart from the use of a certain stabilizing additive, the use of a photoactivator which is more stable than halogenated hydrocarbon has been proposed, e.g., in U.S. Pat. No. 3,502,476. This patent discloses a light-sensitive composition of the printing-out type, essentially consisting of an aromatic amine and a halogenated hydrocarbon or a sulfone compound as the activator. The principal advantage of such an activator is being less volatile than commonly used halogenated hydrocarbons typified by carbon tetrabromide.

However, the effectiveness of the stabilizing additives so far proposed varies considerably depending on the essential components of the light-sensitive composition. Besides, these additives frequently exhibit unfavorable side-effects such as, for example, a noticeable deterioration in the initial sensitivity of the composition and/or a significant coloring of photographic materials.

We have recognized that such unfavorable side-effects of known stabilizing additives are particularly significant when the light-sensitive composition employs N-vinylcarbazole as the N-vinyl compound and includes 4-(p-dimethylaminostyryl)-quinoline as a sensitizer. As is well known, N-vinylcarbazole is one of the most advantageous color-forming compounds in practical applications of the combination of an N-vinyl compound and a halogenated hydrocarbon. It is also well known that 4-(p-dimethylaminostyryl)-quinoline is a superior and practicable sensitizer for light-sensitive compositions of the described type. Accordingly it is of great importance to find an effective and practicable method for the prolongation of the shelf life of a light-sensitive composition containing both N-vinylcarbazole and 4-(p-dimethylaminostyryl)-quinoline.

When, on the other hand, a photoactivator other than halogenated hydrocarbons is used, the light-sensitive system is regarded as a new system having photographic characteristics dissimilar to those of the original system containing a halogenated hydrocarbon. Furthermore, such a new system usually requires photographic processes specific to the system, and the new processes frequently involve the development with a liquid developer, resulting in the loss of the important advantage of the original system, i.e., completely dry operations for the photographic processing thereof.

It is therefore an object of the present invention to provide a light-sensitive composition, which is essentially a dispersed phase of a combination of a halogenated hydrocarbon, N-vinylcarbazole and 4-(p-dimethylaminostyryl)-quinoline in a hydrophilic binder and is able to maintain its inherent high photographic sensitivity for a prolonged period of time compared with essentially analogous compositions of the prior arts.

The invention relates to a light-sensitive composition which is essentially a dispersed phase, in the form of discrete fine particles of a known combination of (A) a halogenated hydrocarbon capable of producing free radicals or ions upon exposure to actinic light, the halogen being selected from chlorine, bromine and iodine, (B) N-vinylcarbazole as a compound capable of forming color with the halogenated hydrocarbon under the influence of actinic light and (C) 4-(p-dimethylaminostyryl)-quinoline as a sensitizer, in a solid-film-forming hydrophilic binder. In accordance with the invention, the combination includes, as an additive to prolong the shelf life, (D) a phenol derivative having the formula

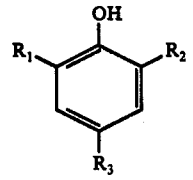

where $R_1$ and $R_2$ are individually an alkyl group having 1 to 4 carbon atoms, and $R_3$ is hydrogen, hydroxyl group, an alkyl group having 1 to 4 carbon atoms or an alkoxyl group having 1 to 4 carbon atoms. The amount of the phenol derivative is from 0.001 to 0.1% by weight of N-vinylcarbazole.

The invention will fully be understood from the following detailed description with reference to the accompanying drawings, wherein:

FIG. 4 is a graph showing the effect of 4SQ on the spectral sensitivity of a light-sensitive composition herein concerned with;

Figure 2:
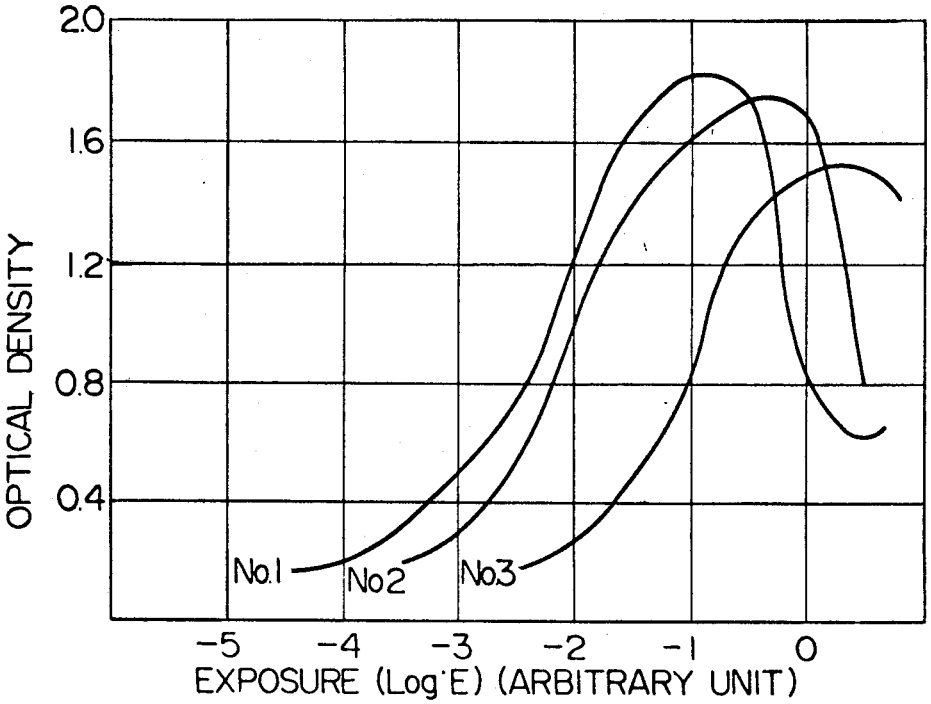
FIG. 2 is a graph showing variations of the H-D characteristic curve of the composition to which the graph of FIG. 1 relates with lapse of time.
Figure 6:
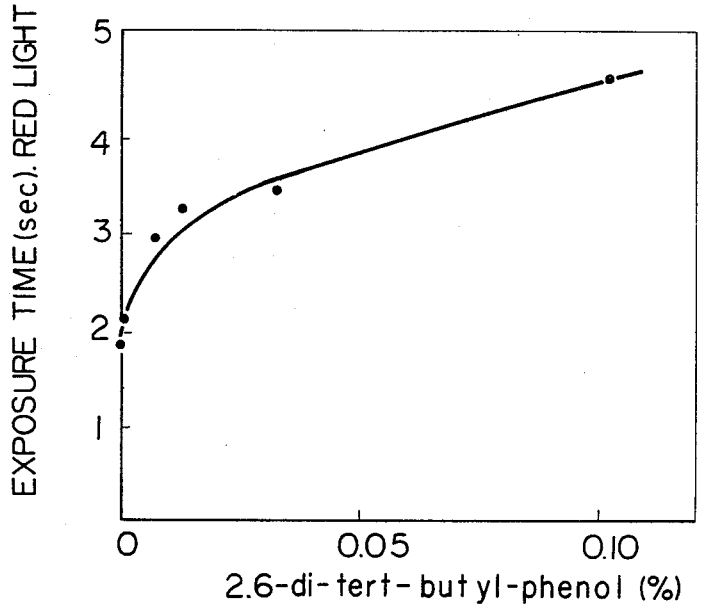
FIG. 6 is a graph showing the relationship between the amount of a phenol derivative added to a known light-sensitive composition containing 4SQ and the optical density of a photographic image obtained by the use of the composition.
Figure 7:
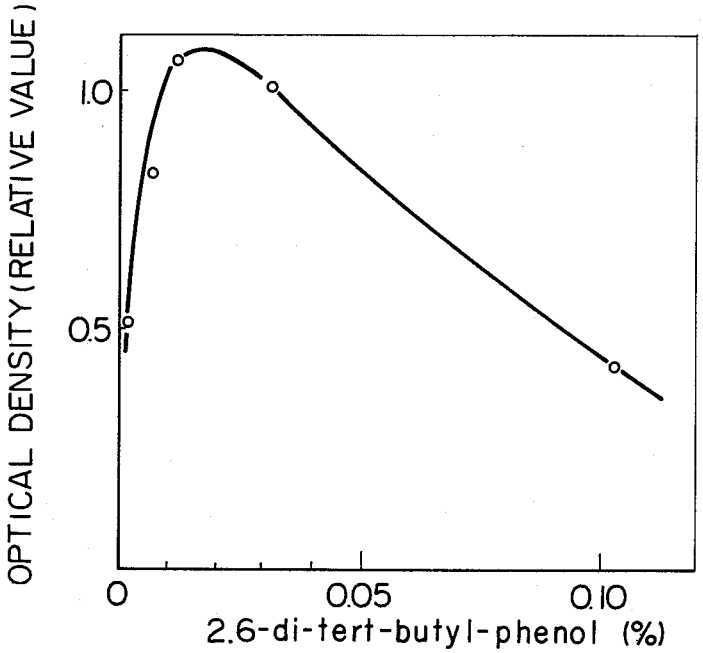
Figure 8:
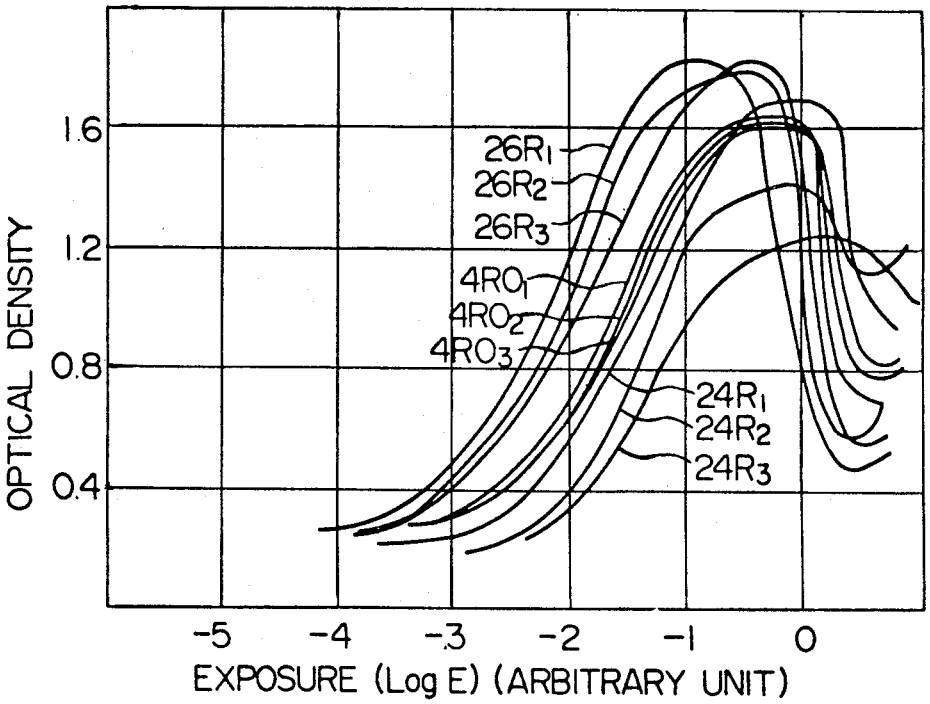

FIG. 7 is a graph showing the relationship between the amount of the same additive as for FIG. 6 and the photographic sensitivity of the composition; and FIG. 8 is a graph generally similar to the graph of FIG. 2 but presents curves of three different groups representing the results of the addition of a phenol derivative according to the invention and two different phenol derivatives not in accordance with the invention, respectively.

A light-sensitive composition according to the invention is characterized by the presence of a specific amount of a phenol derivative selected among a particular group. Other components of the compositions are not different from those which are familiar in conventional compositions both in the kind and amount. Carbon tetrabromide is most preferred as the activator, but other commonly used halogenated hydrocarbons exemplified by carbon tetraiodide, iodoform, hexachloroethane and pentabromoethane are of course useful. The weight ratio of N-vinylcarbazole to halogenated hydrocarbon is in the range from about 5:1 to about 1:5. Examples of preferable hydrophilic binder materials are gelatin, casein, polyvinyl alcohol, carboxymethyl cellulose, polyvinyl pyrrolidone and polyethylene glycol. The amount of 4SQ is in the range from 0.01 to 0.2 Wt% of N-vinylcarbazole.

As is known, the use of 4SQ as a sensitizer in a light-sensitive composition based on the combination of N-vinylcarbazole and a halogenated hydrocarbon is on the premise that a photographic process on the composition includes a blanket exposure to red light for the intensification of a latent image, which was produced by an image-wise exposure to, for example, near ultraviolet range, in advance of a heat development procedure. It is also well known that the sensitizing effect of 4SQ with the implementation of the aforementioned blanket exposure is particularly prominent in negative working processes although the composition can be subjected also to positive working processes. Accordingly, the description will hereinafter be given with regard to a typical negative working process.

Figure 1:
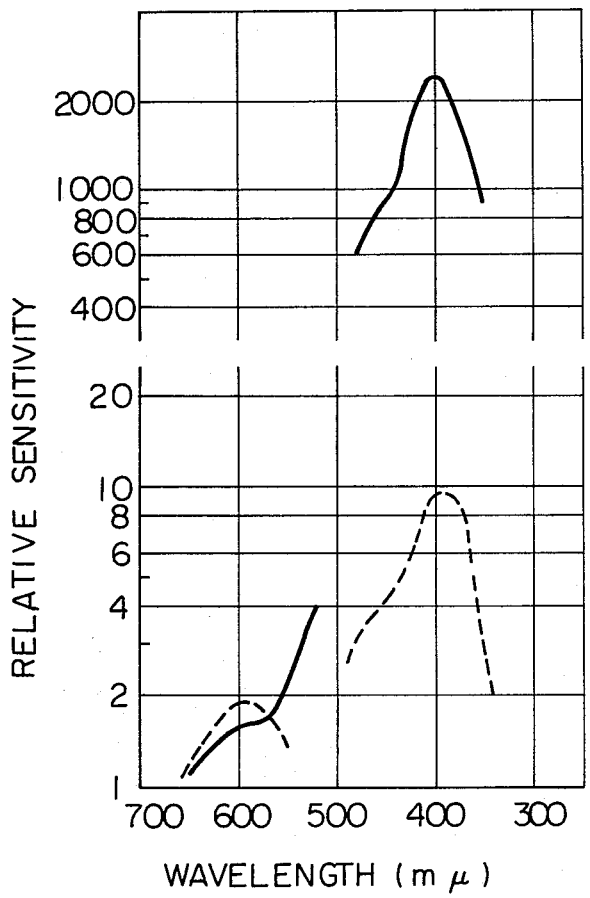
FIG. 1 is a graph showing the effect of a blanket exposure to red light made subsequently to a latent image forming exposure on the photographic sensitivity of a known light-sensitive composition containing 4-(p-dimethylaminostyryl)-quinoline (hereinafter referred to as 4SQ)

The graph of FIG. 1 shows the result of an experiment on the effect of a sensitizing blanket exposure to red light in a negative working photographic process for an N-vinylcarbazole-carbon tetrabromide composition containing 4SQ in an amount of 0.07 Wt% of N-vinylcarbazole. This graph is a translation from spectrograms. The curves given by solid line and broken line represent the employment of the blanket exposure and omission of the same, respectively. This graph shows that the employment of the blanket exposure results in more than hundredfold enhancement of the sensitivity.

A practical example of the deterioration mode with lapse of time in the sensitivity of the prior art light-sensitive compositions is presented in FIG. 2. The three curves are the H-D characteristic curves, which show the relationship between the logarithm of exposure and the optical density of the resulting image, for the same photographic paper. The curves Nos. 1, 2 and 3 represent the results obtained immediately after the preparation of the paper, 1 month and 2 months thereafter, respectively. The light-sensitive composition for the paper was prepared from 10 g of N-vinylcarbazole, 5 g of carbon tetrabromide, 7 mg of 4SQ as a sensitizer and 20 g of gelatin. Initially, N-vinylcarbazole, 4SQ and gelatin were put into 80 ml of water vigorously agitated until a uniform emulsion was obtained. Then carbon tetrabromide was added to the emulsion and the vigorous agitation was repeated. A sheet of baryta paper was coated with this emulsion about 60 microns thick (in the wet state) and dried. The thus produced photographic paper was subjected to an imagewise exposure using a 500-watt xenon lamp through a suitable grey scale. Then the paper was processed through the known steps of a blanket exposure to red light, a 500-watt halogen lamp, for about one sec (intensification of the latent image), heating at 80° C for about 10 see (color development) and another blanket exposure to visible light (complete fixing) to produce a negative image. In FIG. 2, both the exposure and optical density are given in relative values. The absolute values of the exposure measured with flux-meters of the thermocouple type, YHP 8330A and 8334A Radiant Flux-meters, were $5.53 \times 10$ erg/cm$^2$ for log E = O and $5.53 \times 10^{-2}$ erg/cm$^2$ for log E = −5.

As seen in FIG. 2, the paper showed such a progressive dagradation in the sensitivity that the sensitivity after the storage of only 2 months was significantly lower than the initial level.

Such deterioration of this type of system has been considered at least partly to be attributable to a decrease in the concentration of the photoactivator (carbon tetrabromide in the instant case) due to its sublimation from the system. The afore-mentioned replacement of the halogenated hydrocarbon by a non-volatile activator aims mainly at the elimination of such a cause for the deterioration.

In the composition which is dealt with in the present invention, however, the sublimation of, e.g., carbon tetrabromide is not considered a major reason for the deterioration because the particles of carbon tetrabromide are thoroughly involved in the hydrophilic binder. The binding force of a hydrophilic binder or dispersion medium for a halogenated hydrocarbon is stronger than that of a different type of binder, so that the dispersed halogenated hydrocarbon does not so easily sublime as to practically influence the sensitivity of the composition.

From the different point of view, N-vinylcarbazole is considered possibly to polymerize or hydrolyze to a certain extent during storage of the composition and causes the deterioration in the sensitivity. At present, we cannot definitely describe the origin of such reactions of N-vinylcarbazole, but we may be allowed to assume that the reactions are attributable to the partial decomposition of the halogenated hydrocarbon in the composition. Based on this presumption, we have carried out a series of experiments, in which a variety of compounds selected from a group commonly called antioxidant were individually added to the light-sensitive composition of the instant object. As a result, it was recognized that some compounds of such a group have eminent effects on the stabilization of the composition or the prevention of the rapid desensitization thereof during storage.

The known antioxidant compounds which were tested by use may be classified into several groups as exemplified below.

| | | |
|---|---|---|
| Group (a) | imidazoles: | 2-mercaptobenzimidazole<br>Zinc-2-mercaptobenzimidazolate |
| Group (b) | xanthates: | Zinc butyl xanthate<br>Zinc isopropyl xanthate |
| Group (c) | dithiocarbamates: | Zinc dimethyldithiocarbamate<br>Zinc diethyldithiocarbamate<br>Zinc di-N-butyldithiocarbamate<br>Nickel dibutyldithiocarbamate<br>Sodium diethyldithiocarbamate |
| Group (d) | phenol derivatives: | 2,5-di-tert-butyl-hydroquinone<br>2,2'-methylenebis(4-methyl-6-tert-butyl phenol)<br>p-methoxyphenol<br>3,5-di-tert-butyl-hydroxytoluene |
| Group (e) | thioureas: | 1,3-di-o-tolylthiourea<br>1,3-di-phenylthiourea<br>Ethylenethiourea |
| Group (f) | amines: | Aldol-α-naphthylamine<br>Phenyl-β-naphthylamine<br>N,N'-diphenyl-p-phenylendiamine<br>Sym-di-β-naphthyl-p-phenylenediamine |
| Group (g) | others: | Tri-(nonylphenyl) phosphite<br>Dilaurylthiodipropionate<br>Tolyglycidyl ether<br>Mercaptonaphthalene |

The effects of the respective groups of compounds on the photographic characteristics of the prior art composition were examined by adding them individually to the composition hereinbefore described in connection with the graph of FIG. 2. In addition to their effects on the prevention of the quality degradation with lapse of time, the variations in the initial photosensitivity, color tone, and the gamma characteristic were examined as well as the effects on the conditions in the photographic process for the development of the composition. Each additive was introduced into the system in the step of initially dispersing N-vinylcarbazole into an aqueous gelatin solution, and the amount of the additive was from about 0.02 to about 0.1% by weight of N-vinylcarbazole.

The experiments generally revealed the following matters.

Figure 3:
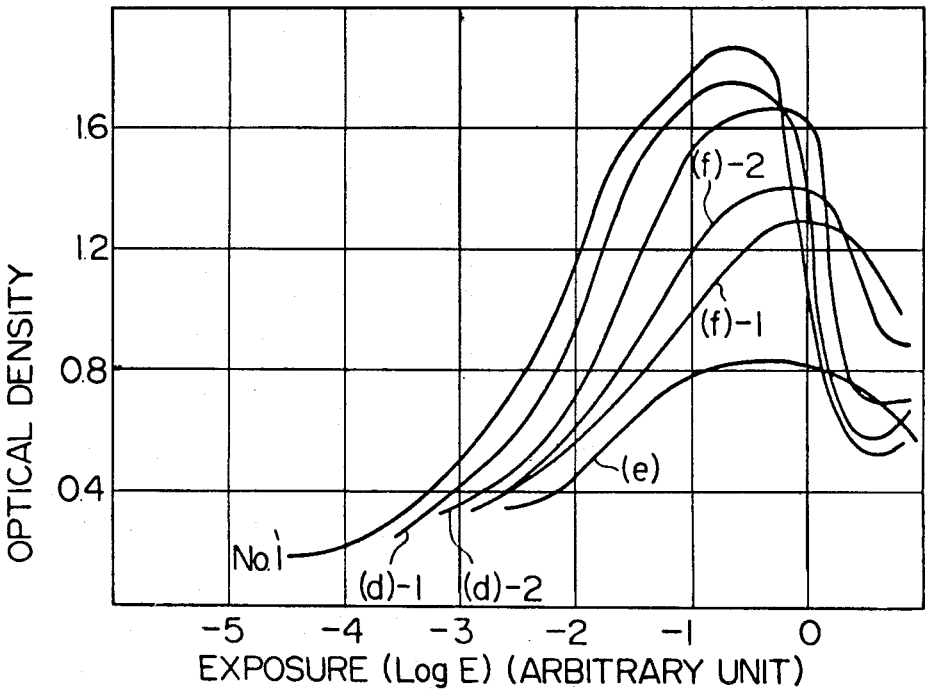
FIG. 3 is a graph showing variations of the H-D characteristic curve of the composition to which the graph of FIG. 2 relates caused by the addition of various antioxidants.

(1) Almost every additive has adverse effects on the initial characteristics of the composition such as the sensitivity, maximum optical density and gamma characteristic. The phenol derivatives, however, exhibited adverse effects to smallest extents. FIG. 3 shows a few examples of the variations in the initial characteristic of the composition resulting from the addition of the antioxidant compounds. All the H-D curves in FIG. 3 were obtained for the same photographic paper and by the same process as in the case of FIG. 2 except for the addition of the additives and that the exposure time in the blanket exposure to red light was prolonged within the range from 2 to 10 sec to compensate for the side-effect of the additive and attain optimum optical densities. Both the abscissa and ordinate of the graph are scaled in the same manner as in FIG. 2. The curve No. 1 of FIG. 3 is identical with the curve No. 1 of FIG. 2, which represents a prior art composition containing no antioxidant. The curve (d)-1 represents the addition of 2,5-di-tert-butyl-hydroquinone, the curve (d)-2 p-methoxyphenol, the curve (e) 1,3-ditolythiourea, (f)-1 β-naphthylamine and (f)-2 hexamethylenetetramine.

(2) The amines including the diamines of a linear chain structure, polyamines and aromatic amines cause relatively large degrees of degradation in the initial sensitivity.

(3) the organosulfur compounds cause the emulsion coating to be tinged with red in addition to the degradation in the initial sensitivity.

(4) The adverse effects of each additive on the initial sensitivity are enhanced as the amount of the additive is increased.

(5) Some compounds of the phenol derivative group can improve the stability or shelf life of the composition substantially without adverse effects on the essential characteristics of the composition.

(6) In general, a slight prolongation of the exposure time in the blanket exposure to red light is desirable when a phenol derivative is employed.

In the above referred U.S. Pat. No. 3,476,562, the improvement on the storage stability by the additives such as phenols and amines is not described in correlation to the use of 4SQ. We have examined, therefore, the applicability of the teaching of this patent to a composition containing 4SQ. In the description of the stabilizing additives in column 28 of No. 3,476,562, a basic composition is of the following formulation (Run 1A):

| | |
|---|---|
| N-vinylcarbazole | 5 g |
| carbon tetrabromide | 5 g |
| gelatin | 8 g in 29 ml of water |
| a foam depressant | about 2 drops |

For comparison, we prepared an analoguous but 4SQ-containing composition of the following formulation, which will be referred to as Run 2A:

| | |
|---|---|
| N-vinylcarbazole | 5 g |
| carbon tetrabromide | 2.5 g |
| 4SQ | 3.5 mg |
| gelatin | 10 g in 40 ml water |

Other than the presence of 4SQ, Run 2A is different from Run 1A in the smaller amount of carbon tetrabromide and absence of the foam depressant. The form depressant is merely for the purpose of suppressing foaming during agitation in the preparation of an emulsion and does not influence the photographic sensitivity of the composition. A difference in the amount of carbon tetrabromide to this degree does not lead to significant differences in the sensitivity and stability between the two compositions. Run 1A and Run 2A can be regarded practically of the same characteristic if 4SQ is disregarded.

The emulsions of Run 1A and Run 2A were respectively coated on baryta paper to a thickness of about 60 microns (in the wet state) to prepare specimens for comparative measurements. Firstly, these specimens were processed to produce negative images without making the above described blanket exposure to red light. After an image-wise exposure to the xenon lamp described hereinbefore with respect to FIG. 2, the specimens were heated at 73° C for 1 minute to develop the image and thereafter exposed to visible light (room light) for complete fixing. The duration of the image-wise exposure was varied with the two specimens to obtain the same optical density of the developed image. As the result, 1 sec was needed with the specimen of Run 1A, but 1.5 sec with Run 2A. For reference, the same specimens were subjected to a positive working process consisting of image-wise exposure to the xenon lamp, blanket exposure to white light for 2.5 sec and heating at 73° C for 1 min. The optimum duration of the image-wise exposure was 0.3 sec with Run 1A but 0.5 sec with Run 2A.

Then, 0.25 g of 2,5-di-tert-butyl hydroquinone and 0.1 g of hexamethylenetetramine were added to both the formulations of Run 1A and Run 2A (in accordance with Run 1G in column 28 of No. 3,476,562). The thus modified Run 1A and Run 2A will be called Run 1G and Run 2G, respectively. The sensitivity of Run 1G and Run 2G were examined firstly by the above described negative working process excluding the blanket exposure to red light. Run 1G and Run 2G needed to slightly prolong the duration of the image-wise exposure compared with Run 1A and Run 2A, respectively, but were regarded as practically unchanged in sensitivity from Run 1A and Run 2A, respectively. Both Run 1G and Run 2G exhibited a satisfactory sensitivity after the sorage of 3 months.

Next, a comparison between Run 2A and Run 2G was made by the employment of a negative working process including a blanket exposure to red light (500-watt halogen lamp) for 2.5 sec between the above described image-wise exposure and heating. Run 2G needed to make the image-wise exposure for 2.5 sec while Run 2A needed only 1/60 sec. This result means that the blanket exposure has no effect on the sensitivity with Run 2G. Seeing this result, we have examined the effect of the blanket exposure with respect to other formulations containing various stabilizing additives referred to as Run 1B to Run 1J in column 28 of U.S. Pat. No. 3,476,562 and found that the blanket exposure was utterly ineffective with everyone of these formulations.

It is concluded from these experiments that the use of hiterto proposed shelf stabilizing additives causes a significant lowering of the initial sensitivity when applied to a composition of the described type containing 4SQ and renders the blanket exposure to red light utterly ineffective.

Naturally it is assumed that the stabilizing additives act on 4SQ in certain ways. We have examined also variations in the sensitivity of the 4SQ-containing composition, i.e. Run 2A, by limiting the amount of each of the stabilizing additives to very small values as is commonly employed for sensitizers such as 4SQ. Even when the additives amounted to less than 0.1 Wt% of N-vinylcarbazole, most of the hitherto propssed antioxidants and polymerization inhibitors caused th blanket exposure to red light to lose its effectiveness with the 4SQ-containing composition. However, we have recognized that some phenol derivatives of a specific structure do not substantially influence the function of 4SQ, i.e. the sensitizing effect of the blanket exposure to red light, when used in relatively small quantities on the compositions typified by Run 2A.

Figure 4:
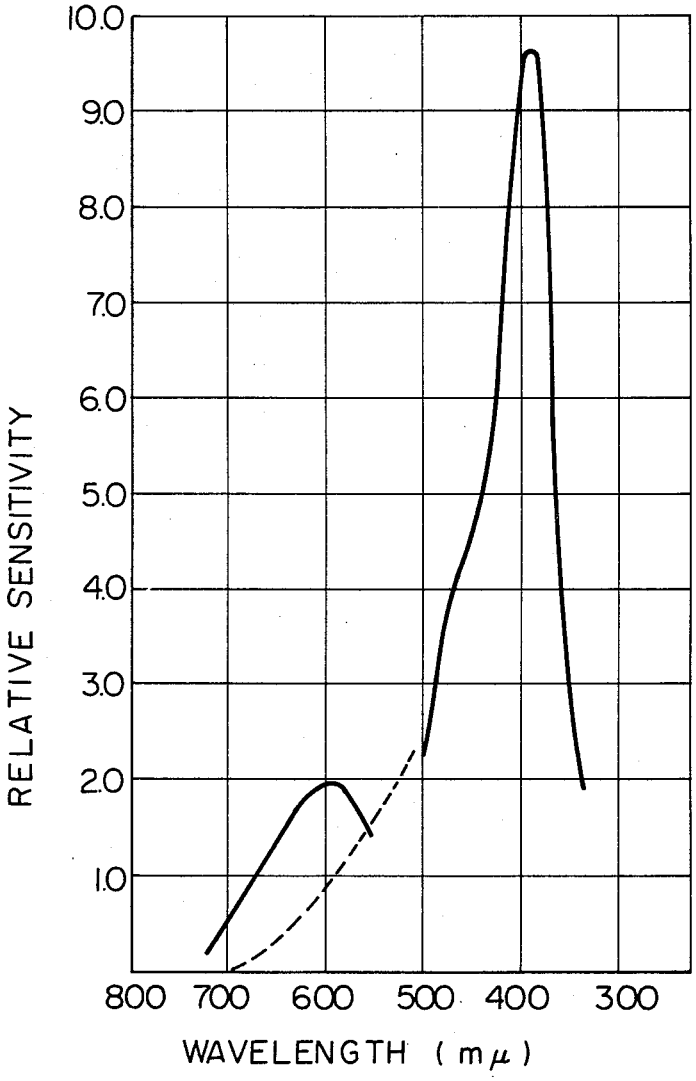

The spectral sensitivity of the 4SQ-containing composition (Run 2A) is as shown in FIG. 4. This graph was prepared from spectrograms. The curves of solid line represents Run 2A, and the curves of broken line represent another composition identical with Run 2A except for absence of 4SQ. As shown, the presence of 4SQ causes the appearance of an absorption band in the wavelength range from about 600 to about 700 mμ. The sensitizing effect of a blanket exposure to red light is related to the appearance of this absorption band.

Figure 5:
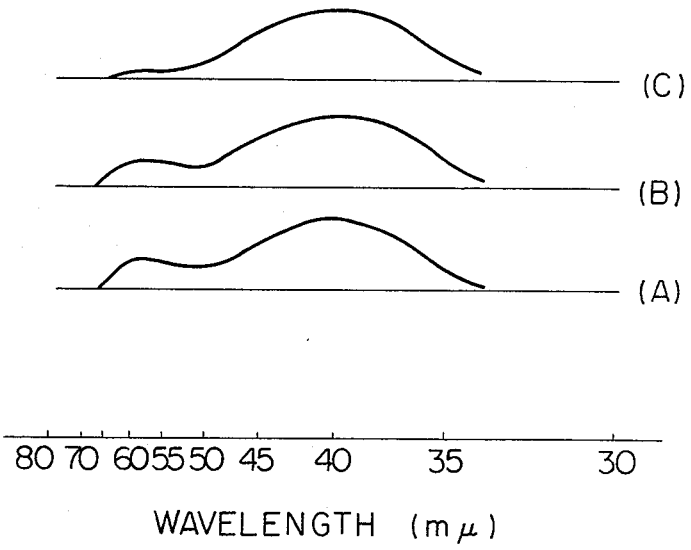
FIG. 5 is a chart showing the spectral absorption characteristic of an exemplary composition of the invention in comparison with slightly altered compositions.

When a phenol derivative useful as a stabilizer is added to this composition, the absorption peak in the longer wavelength range originated from the presence of 4SQ lowers as the amount of the added phenol derivative is increased. The chart of FIG. 5 shows this tendency with respect to Run 2A and 2,6-di-tert-butyl phenol. The figures (A), (B) and (C) of this chart are sketches of spectrograms obtained when 2,6-di-tert-butyl phenol was added to Run 2A in the following quantities, respectively: (A). . . nil, (B) . . . 4 mg (0.08% of N-vinylcarbazole), (C) . . . 7.5 mg (0.15% of N-vinylcarbazole). The spectrograms of these compositions were obtained by means of a SHIMAZU 9F-60 spectrograph having a 150-watt xenon lamp and a quartz dispersion system. The exposure to the xenon lamp was performed for an exponentially varied period of time through a wedgetype slit. (The spectrograms for the preparation of the graphs of FIG. 1 and FIG. 4 were obtained in the same manner.) After the exposure, each of the specimens respectively coated with the three compositions was subjected to a blanket exposure to a 500-watt halogen lamp for an optimum period of time and then subjected to a development heating at 80° C for 20 sec.

The existence of the absorption band with a peak around 600 mμ is apparent in the figure (B), i.e. in the presence of 0.08% phenol derivative, though slightly diminished by comparison with (A). In the case of (C) with 0.15% phenol derivative, the same absorption band is near its disappearance. We have confirmed that a minimum effective exposure time in the blanket exposure to red light of Run 2A varies with the variation in the amount of the added phenol derivative at a rate corresponding to the rate of the diminishing of this absorption band.

The graph of FIG. 6 shows the variation in the minimum effective exposure time to the red light with the variation in the amount of 2,6-di-tert-butyl phenol added to Run 2A. As seen in this graph, the duration of the sensitizing exposure must be progressively prolonged to accomplish the object of the exposure as the amount of the phenol derivative is increased. The reason for such a side-effect of the phenol derivative may be assumed as follows. When 4SQ is present, a latent image formed by the initial image-wise exposure is presumably participated by 4SQ and may include a certain intermediate substance having a sensitivity in the wavelength range around 600 mμ. The phenol derivative may act on such an intermediate substance to suppress the development ability of the latent image. In this connection, we have experienced that photographic materials which were coated with a composition such as Run 2A and deteriorated by storage exhibited a relative increase in the sensitivity in the wavelength range around 600 mμ. Accordingly such an augmentation in the absorption around 600 mμ is considered one of reasons for deterioration of the composition with lapse of time, and the suppression of this phenomenon is considered a reason for the stabilizing effect of phenol derivatives.

Accordingly, we have studied various phenol derivatives further in detail to find out most effective compounds, and it was concluded that a specific group of phenol derivatives characterized by the $C_1$–$C_4$ alkyl substitution at both the 2- and 6 positions to the hydroxyl group serve as particularly eminent stabilizers for the composition of the instant object.

It was also confirmed that the amount of the phenol derivative should be at least 0.001 Wt% (preferably 0.002 Wt%) of N-vinylcarbazole to satisfactorily prolong the shelf life of the composition or photographic materials but 0.1 Wt% at the maximum to avoid a substantial influence on the initial sensitivity.

The graph of FIG. 7 relates to the composition employed for obtaining the graph of FIG. 6. This graph shows a significant influence of the amount of the phenol derivative on the photosensitivity of the composition. It should be noted that the sensitivity of the fundamental composition can even be improved to a certain extent by the addition of the phenol derivative if added in an appropriate and considerably small amount.

The H-D curves of FIG. 8 are typical examples of the experimental results with the phenol derivative-containing compositions. The preparation and photographic process of the photographic papers were similar to those in the case of FIG. 3. The curves 26R, 24R and 4RO represent the addition of 2,6-di-tert-butyl phenol, 2,4-di-tert-butyl phenol and p-ethoxyphenol, respectively, and the subscripts 1, 2 and 3 represent the times at which the papers were processed, viz., immediately after, 1 month after and 3 months after the preparation, respectively. The abscissa and ordinate of this graph are scaled in the same manner as in FIGS. 2 and 3.

The following Table presents a comparison between the properties of the phenol derivatives according to the invention and the properties of slightly different phenol derivatives when added to a 4SQ-containing composition.

The marks in this Table respresent the following properties.

(−) detrimental
(±) somewhat effective but somewhat detrimental
(+) effective
(++) excellent

| Phenols | Initial sensitivity | Shelf life (3 months) |
|---|---|---|
| none | (+) | (−) |
| 2,6-dimethyl phenol | (±) | (±) |
| 2,6-di-isopropyl phenol | (+) | (++) |
| 2,6-di-tert-butyl phenol | (+) | (++) |
| 2,6-di-tert-butyl hydroquinone | (+) | (++) |
| 2,6-di-tert-butyl-p-cresol | (+) | (++) |
| 2,6-di-tert-butyl-4-methoxy phenol | (+) | (+) |
| 2,6-di-isopropyl-4-ethoxy phenol | (+) | (+) |
| 2,4-dimethyl-6-tert-butyl phenol | (+) | (+) |
| 2,5-di-tert-butyl phenol | (+) | (−) |
| 2,4-di-tert-butyl phenol | (−) | (+) |
| 2,5-di-tert-butyl hydroquinone | (−) | (−) |
| 3,5-di-tert-butyl phenol | (−) | (−) |
| 4-methoxy phenol | (−) | (+) |
| 4-tert-butyl phenol | (−) | (−) |

-continued (−) detrimental
(±) somewhat effective but somewhat detrimental
(+) effective
(++) excellent

| Phenols | Initial sensitivity | Shelf life (3 months) |
|---|---|---|
| p-cresol | (−) | (−) |

The amines are considered unsuitable for the purpose of the invention because of their marked tendency of reducing the initial sensitivity of the composition as described hereinbefore. It was discovered, however, that the shelf like of the composition can be further prolonged when an antioxidant amine is added together with the phenol derviative according to the invention. In such a case, the amount of the amine should be less than the amount of the phenol derivative and is preferably limited to 50% at most by weight of the phenol derivative.

The invention will be further illustrated by the following examples.

EXAMPLE 1

A standard (reference) light-sensitive composition was prepared from the following materials.

| | |
|---|---|
| N-vinylcarbazole | 10 g |
| carbon tetrabromide | 5 g |
| 4 SQ | 7 mg |
| gelatin | 20 g |

These materials except for the carbon tetrabromide were put into 80 ml of water and vigorously stirred in a Waring blender until a uniform emulsion was obtained. Then the carbon tetrabromide was added to the emulsion and the stirring was repeated. The emulsion was coated on baryta paper to a thickness of about 60 microns (wet thickness), and the coated paper was air-dried at room temperature or in an oven kept at about 50° C. The thus produced light yellow photographic paper was used as a standard paper.

Another light-sensitive composition was prepared similarly except that 4 mg of 2,6-di-tert-butyl phenol was added to the water before the initial stirring. This composition was used to produce a sample photographic paper by the same procedures.

Both the standard and sample papers were stored in a dark chamber maintained at a temperature of 30° C and 60% relative humidity and subjected to a photographic process and measurement for producing the H-D curves at the interval of 10 days. The photographic process was of the usual manner for a composition essentially consisting of a halogenated hydrocarbon and an N-vinyl compound, comprising the steps of an imagewise exposure to a xenon lamp, blanket exposure to red light (a 500-watt halogen lamp), heating at 80° C for 10 sec, and blanket exposure to visible light. The exposure time in the first blanket exposure was 2 sec for the standard paper and 3.5 sec for the sample paper. The standard paper commenced to exhibit a notable and progressive degradation in the sensitivity after the lapse of 2 months such that the maximum optical density was about 80% of the initial value while lowering in the sensitivity was nearly by one range of exposure on the indicated relative scale. However, the sample paper coated with the composition according to the invention exhibited substantially no deterioration even after the lapse of 5 months.

EXAMPLE 2

Example 1 was repeated except that the stabilizing additive for the second composition was 3.5 mg of 2,6-di-tert-butyl-p-cresol. The sensitivity of the sample paper after the storage of 5 months was not appreciably different from the initial value.

EXAMPLE 3

Example 1 was repeated except that the stabilizing additive for the second composition was 4 mg of 2,6-di-isopropyl phenol. The result was similar to Example 2.

EXAMPLE 4

Example 1 was again repeated except that the stabilizing additive was 3.8 mg of 2,4-dimethyl-6-tert-butyl phenol and that the exposure to the red light was performed for 2.8 sec. The result was substantially similar to that in Example 2.

EXAMPLE 5

The carbon tetrabromide in Example 1 was replaced by the same amount of iodoform, and 8 mg of 2,6-diisopropyl-4-ethoxy phenol was used as the stabilizing additive. The production of the photographic papers, storage thereof and the measurement were carried out in the same manners as in Example 1 except that the exposure to the red light was performed for 3 sec. In the measurement carried out immediately after the production of the photographic papers, the sample paper showed a slightly lower sensitivity than the standard paper. To describe numerically, the maximum optical density of the image on the sample paper was about 90% of that on the standard paper, and the relative exposure for the image density of 0.6 for the sample paper was of the magnitude of about 2 times as large as that for the standard paper. However, the sample paper had a satisfactory shelf life like the sample papers in the previous Examples.

EXAMPLE 6

Also this example is similar to Example 1 except that the carbon tetrabromide was replaced by the same amount of hexachloroethane and that the stabilizing additive was a combination of 3.5 mg of 2,6-di-tertbutyl-hydroquinone and 2 mg of hexamethylenetetramine and that the exposure to the red light was performed for 3.5 sec. The sample paper exhibited substantially no degradation in the sensitivity after the storage of 6 months but gave a maximum optical density corresponding to about 90% of the maximum optical density given by a fresh composition containing neither the phenol derivative nor the amine.

What is claimed is:

1. A light-sensitive composition comprising (1) a dispersed phase in the form of discrete fine particles of a light-sensitive combination of (A) a halogenated hydrocarbon capable of producing free radicals or ions upon exposure to actinic light, the halogen being selected from the group consisting of chlorine, bromine and iodine, (B) N-vinylcarbazole as a compound capable of producing color with said halogenated hydrocarbon under the influence of actinic light, (C) 4-(p-dimethylaminostyryl)-quinoline as a sensitizer, and (D) a phenol derivative, as an additive to prolong the shelf life, having the formula

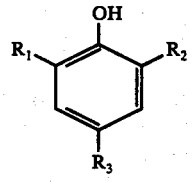

where $R_1$ and $R_2$ are individually an alkyl group having 1 to 4 carbon atoms, and $R_3$ is hydrogen, hydroxyl group, an alkyl group having 1 to 4 carbon atoms or an alkoxyl group having 1 to 4 carbon atoms, the amount of said phenol derivative being from 0.001 to 0.1% by weight of said N-vinylcarbazole, in (2) a solid-film-forming hydrophilic binder in which said dispersed phase is substantially insoluble.

2. A composition according to claim 1, wherein said phenol derivative is selected from the group consisting of: 2,6-di-tert-butyl phenol, 2,6-di-tert-butyl-p-cresol, 2,4-dimethyl-6-tert-butyl phenol, 2,6-di-isopropyl phenol 2,6-di-tert-butyl-hydroquinone and 2,6-di-isopropyl-4-ethoxy phenol.

3. A composition according to claim 2, wherein the amount of said 4-(p-dimethylaminostyryl)-quinoline is in the range from 0.01 to 0.2Wt% of said N-vinylcarbazole.

4. A composition according to claim 3, wherein said halogenated hydrocarbon is selected from the group consisting of carbon tetrabromide, iodoform and hexachloroethane.

5. A composition according to claim 3, wherein said hydrophilic binder is gelatin.

6. A composition according to claim 1, wherein said combination further comprises an antioxidant amine in an amount less than the weight of said phenol derivative.

7. A composition according to claim 6, wherein the amount of said amine is less than 50% by weight of said phenol derivative.

8. A composition according to claim 7, wherein said amine is hexamethylenetetramine.

9. A composition according to claim 5, wherein the amount of said phenol derivative is from 0.002 to 0.1% by weight of said N-vinylcarbazole.

* * * * *